United States Patent [19]

Saunders

[11] 4,304,978

[45] Dec. 8, 1981

[54] HEAT TREATING USING A LASER

[75] Inventor: Richard J. Saunders, San Jose, Calif.

[73] Assignee: Coherent, Inc., Palo Alto, Calif.

[21] Appl. No.: 948,917

[22] Filed: Oct. 5, 1978

[51] Int. Cl.[3] ..... B23K 26/00

[52] U.S. Cl. ..... 219/121 L; 219/121 LM; 219/121 EB; 219/121 EM

[58] Field of Search ..... 219/121 LM, 121 L, 121 EB, 219/121 EM; 148/13, 135, 143

[56] References Cited

U.S. PATENT DOCUMENTS

| | | | |
|---|---|---|---|
| 687,612 | 11/1901 | Davis | 219/121 R |
| 2,060,985 | 11/1936 | Frickey | 219/121 R |
| 2,194,909 | 3/1940 | Moss et al. | 219/121 R |
| 4,093,842 | 6/1978 | Scott | 219/121 LM |
| 4,151,014 | 4/1979 | Charschan et al. | 219/121 LM X |

*Primary Examiner*—C. L. Albritton

*Attorney, Agent, or Firm*—Limbach, Limbach & Sutton

[57] ABSTRACT

A method and apparatus are disclosed utilizing a laser for heat treating a transformation hardenable workpiece. Sufficiently high laser power densities are provided at the workpiece surface to cause an incandescent reaction with the workpiece, but incandescent reaction is limited to a sufficiently short period of time to prevent any substantial melting of the workpiece. Pre-conditioning the workpiece prior to heat treatment, squelching the workpiece with a gaseous jet, and techniques for work-hardening cylindrical workpieces are also disclosed.

29 Claims, 7 Drawing Figures

HEAT TREATING USING A LASER

BACKGROUND OF THE INVENTION

Until recently, transformation hardening of metals, primarily irons and steels having a minimum carbon content of approximately 0.2%, has been done primarily using induction heating techniques. More recently, lasers, particularly highpower $CO_2$ lasers, have begun to replace induction-hardening and other case-hardening techniques, where minimum distortion and/or selective hardening of the workpiece is desired. An example of utilization of a laser for heat treating applications is U.S. Pat. No. 3,957,339.

Deficiencies exist with state of the art laser heat treating techniques. Existing laser heat treating, like the induction heat treating, often results in stressed or distorted parts. Where the applied heat from the laser is at power densities which are too low, optimum heat treating does not take place. Where power densities are maintained too high or for excessive time periods, distortion and melting takes place. This requires postheat treat straightening and machining. This is quite expensive and time consuming.

Nor does the known prior art laser heat treating provide for pre-conditioning of workpieces to optimally couple laser energy from the laser to the workpiece. Additionally, little attention has been given to a problem of optimum heat treating of cylindrical workpieces such as small diameter shafts and axles.

SUMMARY OF THE INVENTION

It is therefore an object of the invention to provide an improved method and apparatus for heat treating with a laser.

Another object of the invention is to provide an improved technique for heat treating transformation hardenable materials using a laser which does not require post-machining of the workpieces treated.

Another object of the invention is to provide improved laser heat treating which does not induce stresses and distortion into the workpiece being treated.

Another object of the invention is to provide an improved heat treating method and apparatus for heat treating cylindrical workpieces.

Another object of the invention is to provide an improved method of heat treating wherein the workpieces are preconditioned prior to heat treating.

In accordance with the present invention, a laser beam is directed onto the surface of a transformation hardenable material at sufficiently high power densities as to cause an incandescent reaction with the workpiece. At the same time, the dwell time of the laser beam on the work surface is kept sufficiently short so that no significant melting of the workpiece takes place.

Unlike prior art heat treating systems using a laser, it has been found that a key to successful heat treating of transformation hardenable materials is to heat the workpiece to temperatures which, under normal techniques of laser heat treating, would result in excessive melting of the material being heat treated.

The temperature of an incandescent reaction is typically greater than that which will melt the material being heat treated. Melting does not take place, however, for several reasons. First, the dwell time—the time the laser beam impinges on the work surface—is kept very short. This is accomplished in two ways. The beam is traversed over the workpiece at a sufficiently high rate that the dwell time is kept short. Also, the laser beam is projected as a narrow line perpendicular to the traverse direction, so that the exposure time of the laser beam is kept short.

Second, a gas jet is used to maintain the workpiece being treated at uniform, and comparatively low temperatures. When the laser beam impinges on the workpiece, therefore, less possibility of melting is likely to occur.

Heat-treated workpieces in accordance with the present invention show excellent results with little induced stress or strain. As a result, significant cost reductions can be realized since no subsequent machining is required in high precision applications.

While no significant melting has been observed, it is possible that with the incandescent reaction there are small amounts of localized surface melting. Such melting, if it exists, is limited to the very top layer of the workpiece and does not cause any measurable surface deformation of the workpiece.

Results utilizing the present invention have shown transformation hardening in materials from two mils to thirty mils in depth.

In accordance with another aspect of the invention, workpieces are pre-conditioned prior to heat treating. This is accomplished by forming a thin, uniform layer on the surface of the workpiece. The layer has the characteristic that it is absorbtive of energy at the wavelength of the laser beam and acts to more effectively couple the laser energy into the workpiece.

In one actual embodiment, the laser used for heat treating was a $CO_2$ laser, with a principle wavelength of 10.6 microns. Oxides and phosphates are very absorbtive of energy at this wavelength. A thin oxide or phosphate layer is put on the workpiece prior to heat treating. By doing so, energy is more effectively coupled into the workpiece without causing melting. The oxide/phosphate layer does not appear to affect the work-hardening of the workpiece.

In accordance with yet another aspect of the invention, an improved technique is set forth for heat treating cylindrical workpieces such as small diameter shafts and axles. As will be set forth in greater detail subsequently, this involves the procedure of hardening the cylindrical workpiece along spiral bands, but at the same time, leaving a spiral soft band on either side of the work-hardened area which is not heat treated.

The foregoing and other objectives, features and advantages of the invention will be more readily understood upon consideration of the following detailed description of certain preferred embodiments of the invention, taken in conjunction with the accompanying drawings.

DESCRIPTION OF THE PREFERRED EMBODIMENTS

Figure 1:
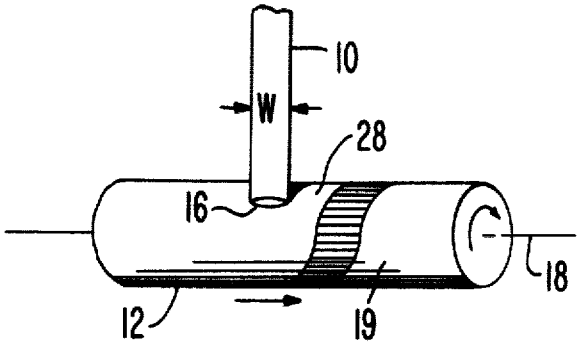
FIG. 1 is an illustration of the principles of the present invention for work-hardening of a cylindrical workpiece.
Figure 2:
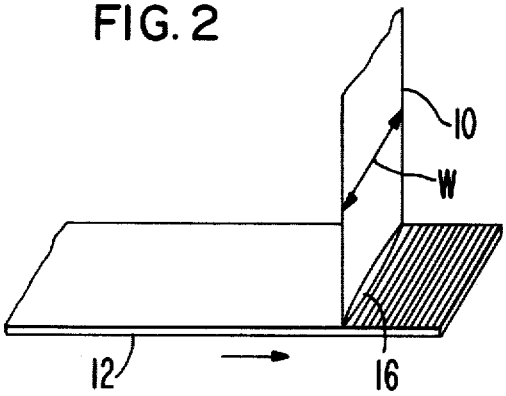
FIG. 2 is an illustration in accordance with the present invention for work-hardening a flat workpiece.

FIGS. 1 and 2 illustrate, respectively, the heat treating technique of the present invention for a cylindrical and flat workpiece. In FIG. 1, a laser beam 10 is directed perpendicularly to a transformation hardenable workpiece 12, such as an axle or shaft. In FIG. 2, workpiece 12 is flat, such as a knife or blade. In both cases, the laser beam 10 is focused along one axis by a cylindrical lense 14 (shown in FIGS. 3 and 4). This results in a laser beam which is a "flat" plane and results in the projection of a narrow line of light 16 where the laser beam intersects the workpiece.

The energy densities of the laser beam 10 where it strikes the workpiece 12 is sufficiently high that an incandescent reaction with the workpiece takes place. This is an indication that the temperature at the surface of the workpiece is sufficiently high that melting would take place. However, by minimizing the dwell time, that is, the period in which the focused laser beam intersects a particular area on the workpiece, no substantial melting takes place.

Figure 3:
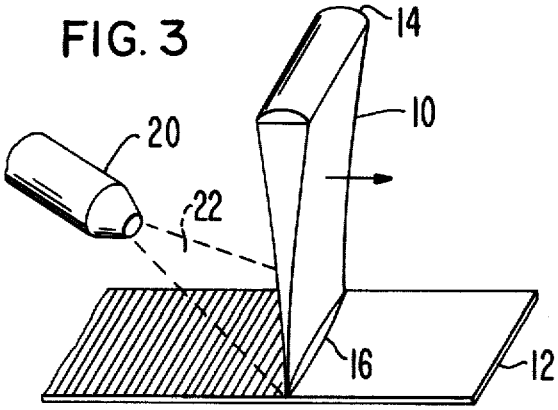
FIG. 3 is an illustration of the present invention showing the use of a gas jet for quenching the workpiece.

To minimize the dwell time, the laser beam 12 is traversed rapidly over the workpiece surface. In the case of a flat workpiece (FIGS. 2 and 3), the target line or slit 16 of the laser beam 10 traversed along the workpiece 12. This can be accomplished either by moving the workpiece 12 relative to the laser beam 10 as shown in FIG. 2, or by passing the laser beam 10 along the stationary workpiece as shown in FIG. 3.

Figure 4:
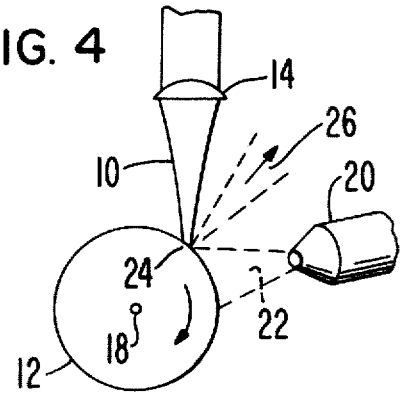
FIG. 4 is an illustration in accordance with the present invention showing the use of a gas jet for quenching a cylindrical workpiece.

In the case of a cylindrical workpiece, such as shown in FIGS. 1 and 4, the workpiece 12 is rotated about its longitudinal axis 18 at the same time the workpiece 12 is moved longitudinally relative to the laser beam 10. As a result, the area which is transformation hardened follows a path or band 19 which is generally of a spiral (barberpole) shape.

The dwell time is also kept short by the choice of the shape and orientation of the projected laser beam on the workpiece. In accordance with the present invention, the width W of the laser beam 10, i.e. the dimension of the laser beam along the unfocused axis, defines the dimensional width of the area being heat treated as it is scanned by the laser beam. The orientation of the projected laser beam line 16 is perpendicular to the rotational or traverse direction. As a result, as the beam passes over the workpiece, it very quickly passes over any given area.

Typical beam dimensions on the workpiece, after focusing with a cylindrical lense, measure about 0.450" to 0.625" wide on the unfocused axis, and about 0.005" to 0.020" on the focused axis. This results in a hardened zone width of about 0.350" to 0.500". With the same laser conditions and a focusing lense which produces a round spot, the minimum beam diameter which can be used without severe melting is approximately 0.100", while the maximum diameter is approximately 0.150". This means that the actual coverage rates in square inches per minute for transformation hardening is much lower for a round spot when compared with a line focus produced with a cylindrical lense, oriented in the proper direction using the same laser power output levels.

Figure 7:
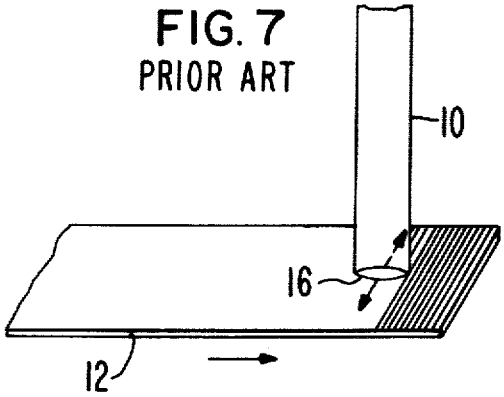
FIG. 7 PRIOR ART
FIG. 7 is an illustration of a prior art work-hardening technique.

This is also in contrast with the prior art as shown in U.S. Pat. No. 3,957,339, where the laser beam, also projected as a plane of light, is oriented so that the resulting projected line of laser light on the workpiece 12 is parallel with the direction of movement of the workpiece 12. The width of the band which is heat treated by the laser beam 10 is determined by oscillating the laser beam 10 back and forth in a direction perpendicular to the direction of the passage of the workpiece. This approach is illustrated in FIG. 7.

This latter approach has several disadvantages. First, it requires more elaborate mechanical apparatus to oscillate the beam back and forth across the workpiece. Secondly, where a curved workpiece is involved, such as shown in FIG. 1, because the beam would be oriented perpendicular to the plane of the beam of FIG. 1, the projected laser line would lie on a curved surface, resulting in an in and out of focus condition in relation to the optical focal plane, and uneven heating would result. Third, as will be described in greater detail subsequently, it is very important for the start and stop of the heat treating to take place at almost exactly the same point. With the beam oscillating back and forth, it is almost impossible to achieve this result. Finally, with the beam oriented in the same direction as the scan direction, short dwell times are not achieved, since any given area of the workpiece passes through the long or unfocused dimension of the projected beam.

It has been found that incandescent reaction and satisfactory heat treating of transformation hardenable materials takes place with power densities in the range of 100 to $160\times10^3$ watts/square inch, with a dwell time of from approximately 0.17 to 0.26 seconds. Of course, the particular power density, as well as the particular dwell time, will depend upon the particular workpiece being treated. Such factors as the type of material of the workpiece and the size and shape of the workpiece will influence both the power density as well as the dwell time required.

An incandescent reaction is contrasted with a reaction which occurs at lower temperatures when the workpiece glows a red color, i.e. is "red hot". Despite the fact that an incandescent reaction occurs at temperatures above the melting point of the workpiece, as long as the dwell time is kept sufficiently short, no massive melting of the workpiece occurs. This is important for proper heat treating of transformation hardenable materials. It is possible that there is some localized melting at the surface of the workpiece, but in no event is there any massive or large-scale melting of the workpiece.

In accordance with another aspect of the invention, a gaseous jet is used to quench the workpiece immediately after heat treating. It has been found that gas quenching is particularly advisable for low mass parts. Gas quenching serves to prevent heat build-up in the workpiece and therefore helps to prevent melting and increases the hardness of the heat-treated zone by quenching the material as the hot zone is moved.

An air jet 20 is shown in FIGS. 3 and 4 for a flat and cylindrical workpiece respectively. The gas jet 20 projects a jet or stream 22 of gas or air so that it impinges upon the workpiece directly behind the intersection of the laser beam 10 and the workpiece 12.

In some cases, air is used to quench the reaction and in other cases, an inert gas such as nitrogen is used. Air is used where additional oxidation is required to assist the incandescent reaction. The air reacts with the workpiece to form oxides, which in turn more effectively couple energy into the workpiece.

In some cases, an oxidizing reaction is not desired, as, for example, when heat treating stainless steel or very thin parts. In such cases, an inert gas such as nitrogen or helium is used.

Referring to FIGS. 1 and 4, best results are achieved when the laser beam 10 is directed to a position 24 which is off the vertical axis of the cylindrical workpiece 12. The light 26 which is not absorbed and which is reflected off of the workpiece 12 does not reflect back into the lense 14. This prevents damage to the lense in the laser system.

While in the preferred embodiment the laser chosen is a $CO_2$ laser with an output wavelength of 10.6 microns, other lasers such as a YAG laser can be utilized. Additionally, it is to be understood that although the term "light" has been used to describe the output of the $CO_2$ laser, in fact, the beam is not visible to the naked eye; rather, it is outside the visible portion of the spectrum. Nonetheless, it may properly be characterized as "light" and the use of that term is not intended to limit the scope of the present invention.

Light energy from the laser is more effectively coupled into the workpiece by proper pre-conditioning of the workpiece. Oxides and phosphates are effective materials for coupling the 10.6 micron wavelength of a $CO_2$ laser. Prior to heat treating, parts are coated, sprayed or dipped, in accordance with well known coating processes, to form a very uniform layer of oxide or phosphate or other material which is absorbent to the wavelength of the laser. It is very important that this layer be uniform.

Techniques for phosphate and oxide coating of metal, sometimes referred to as "black oxidizing," may be found in *Metals Handbook*, 8th edition, 1972, published by the American Society For Metals. Reference is made to volume 2, entitled "Heat Treating, Cleaning and Finishing," pages 531–547.

It is important that the oxide or phosphate layer which is formed not be too thin. If it is, it becomes essentially transparent to the laser beam. As a result, the underlying metal surface, which is reflective, reflects a substantial portion of the light energy away, thereby ineffectively coupling the energy from the laser beam.

In the areas where work-hardening has taken place, a slightly textured surface of oxide results. This can be removed by a light wire brushing. Additionally, if it is desired to remove the oxide layer in areas that have not been exposed to the laser beam, hydrochloric acid can be used to remove the oxide or phosphate layer.

It has also been found that when heat treating cast iron parts, slightly thicker layers of oxide are most effective since additional heat energy can be coupled into the workpiece. Also, in general, the smaller the part, the shorter the dwell time and the lower the power densities that should be used.

Reference is made in FIG. 1 to an improved technique for heat treating a cylindrical workpiece. As may be seen in that figure, the workpiece 12 is rotated during the heat treating operation; additionally, the beam 10 is traversed or passed along the workpiece 12 in a direction generally parallel with the longitudinal axis 18 of the workpiece. As a result, as it is set forth above, the resulting work-hardened area defines a spiral or barberpole pattern on the workpiece.

By adjusting the rotational speed and the laser scan rate, it is possible to provide spiral patterns on the workpiece which are separated by non heat-treated or "soft" zones 28. These zones alternate between the work-hardened zones and hence, also have a spiral or barberpole configuration.

Using this approach, better wear characteristics occur. It is believed that abrasive particles which are formed as the workpiece is used become embedded in the "soft" zones. This keeps abrasive particles away from the work-hardened zones, thereby increasing their life. It also believed that with the spiral shape of the "soft" zones, the abrasive particles migrate along the "soft" zones in a direction depending upon the rotational direction of the shaft. Eventually, the abrasive particles migrate totally out of the wear zone of the part.

As an example, the typical dimensions of the hardened and "soft" zones are given for a 0.38" diameter steel shaft. The spiral hardened zone has a width of 0.300" to 0.400". The "soft" zone may range from 0.030" to 0.100" in a continuous spiral. Test results indicate approximately three times better wear characteristics for the aforedescribed alternating hard and "soft" zones versus the wear characteristics of the same part treated by induction hardening.

Figure 5:
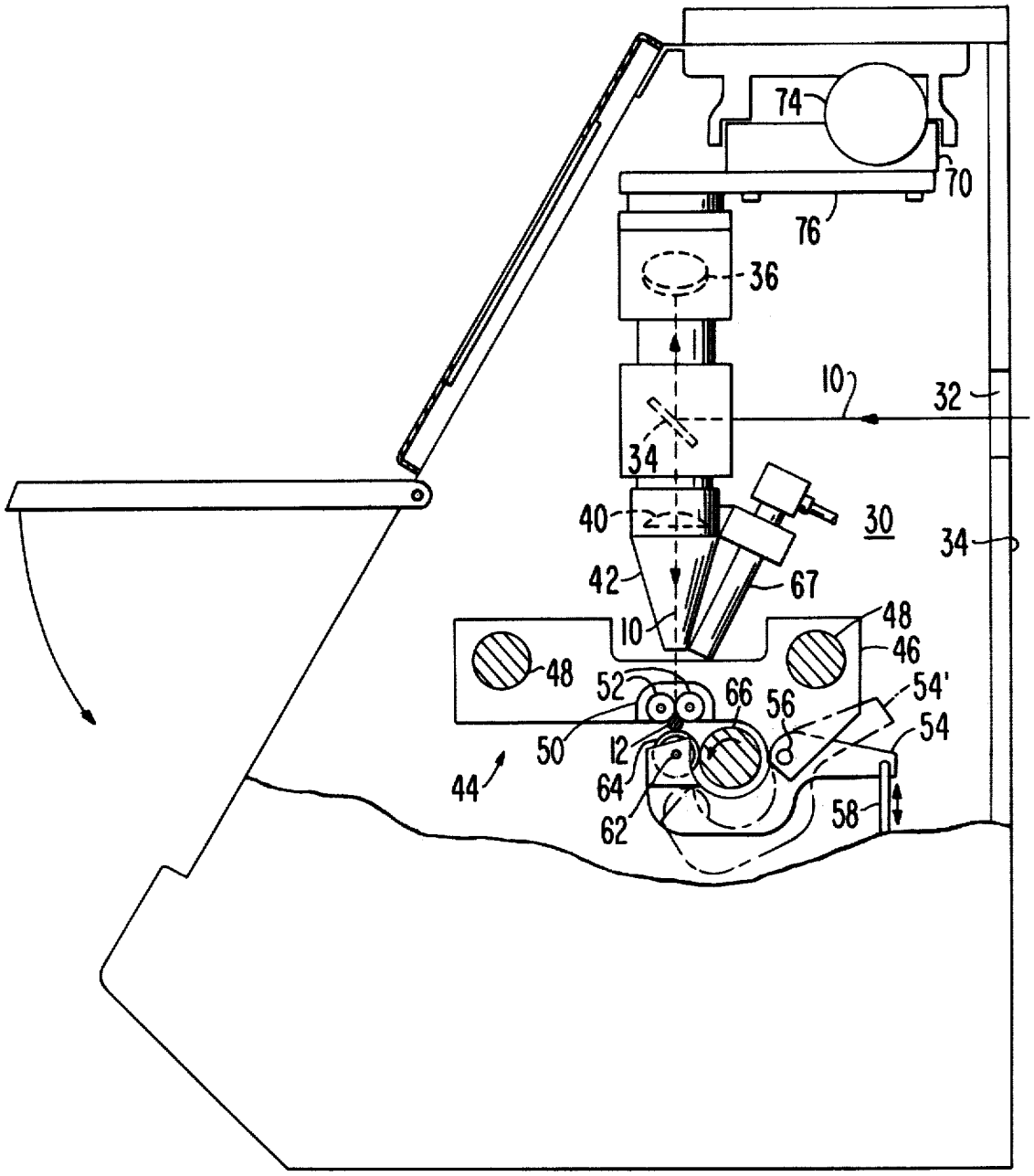
FIG. 5 is a cross-sectional view of an actual embodiment of the present invention; and, FIG. 6 is a front view of an actual embodiment of the present invention.
Figure 6:
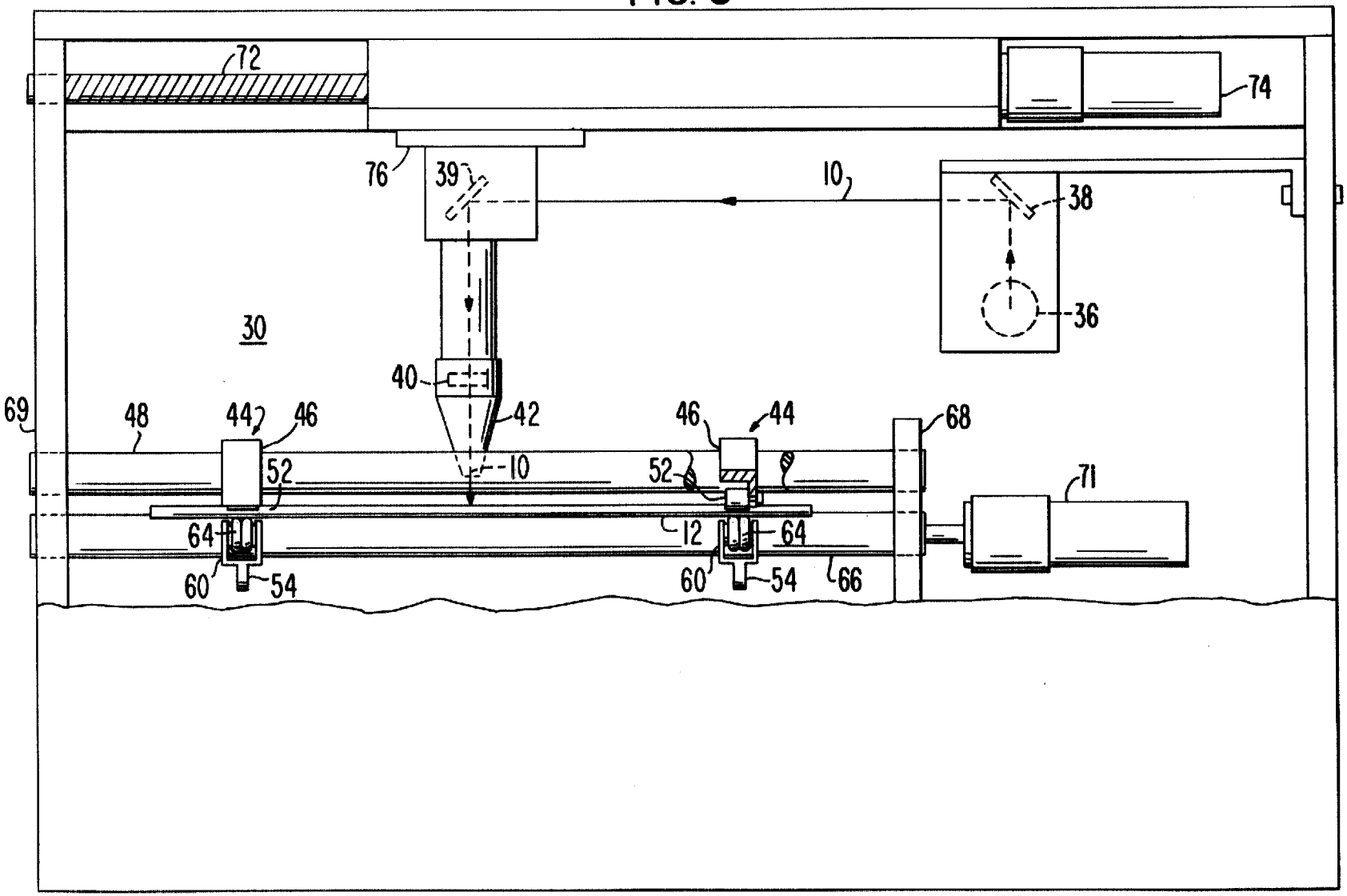

Using the same 0.38" diameter steel shaft as an example, the power densities set forth previously for creating an incandescent reaction may be achieved if the shaft is rotated in a range of from 20–30 rpm using a 500 watt Coherent EVERLASE TM laser, and with a 2.5" focal length cylindrical lense (see FIGS. 5 and 6). The scan rate along the axis of the workpiece is, of course, a function of the desired spacing between adjacent bands of work-hardened zones.

In order to achieve distortion-free heat treating of small diameter shafts (0.5" or less), it is necessary to produce an instantaneous start and predetermined finish of a spiral heat-treat zone. This can only be achieved repeatably with a cylindrical lense focused to a high power density perpendicular to the rotational axis of the shaft and a uniform oxide coating. If a round beam spot or a scanning optical spot is used, the power density is insufficient to initiate an instantaneous reaction. Since it is necessary to start and finish the spiral pattern at the same location radially along the shaft to prevent distortion, a cylindrical lense must be used. A black oxide surface coating has been proven to be very absorptive at 10.6 microns. The coating also lends itself to uniformity, another important factor for minimum distortion.

Shafts, 0.38" in diameter and 5.0" long, have been repeatably hardened with three spiral zones, each 1" long. The maximum measured run out was 0.0005". In all heat-treating samples, the surfaces required no post machining or grinding. No measurable deformation was produced in the hardened zones.

Some examples of the specific work-hardenable materials which have been successfully heat treated in accordance with the present invention, include:

SAE 1060
SAE 1050
SAE 11244
SAE 1144 and
SAE 440C (stainless steel)

One actual embodiment of the invention is shown in FIGS. 5 and 6 which illustrate a heat treating apparatus 30. The laser beam 10 enters through an opening 32 at the back of the housing 34. It is then reflected by a series of three reflectors 36, 38 and 39 and finally through cylindrical lense 40 which is located within the gas nozzle 42, and onto the cylindrical workpiece 12 in the manner previously described.

The workpiece 12 is supported and rotated by a pair of workpiece handling mechanisms 44, which include a pair of support carriages 46 which are supported by a pair of ways 48. Each of the carriages 46 can be moved along the ways 48 to accommodate workpieces of different lengths.

Supported within a recess 50 in each of the carriages 46 are a pair of support and alignment rollers 52. Rollers 52 are supported on horizontal axes and rotate freely as the workpiece 12 rotates. As described previously, the rollers 52 are positioned in such a way that the laser beam 10 strikes the surface of the workpiece 12 slightly off the vertical axis of the workpiece.

Each of the carriages 46 supports a rocker arm 54 by means of a pivot 56. The rocker arm 54 is terminated by a bifurcated portion 60 which supports an axle 62 and a pair of drive rollers 64, which engage the workpiece 12 when a workpiece is inserted into the heat treating apparatus 10. When the rocker arm 54 is in a position indicated by solid lines in FIG. 5, the drive roller 64 engages the rotating shaft 66. The shaft 66 is suitably supported by support members 68 and 70. Support member 68 also supports the variable speed motor 70 which drives the shaft 66.

When the lever arm 58 is moved upward, the arm 54 pivots about pivot 56 to the position 54' indicated by broken lines. In operation, when the operator desires to heat treat a new workpiece 12, the lever 58 is moved upward and the arm 54 is moved out of engagement with the shaft 66. The operator then takes out the previous workpiece which has now been heat treated and places a new workpiece adjacent to the rollers 52. The lever arm 58 is then pulled downward such that the drive wheel 64 engages the bottom of the workpiece 12. Additionally, this causes the drive wheel 64 to be engaged by the rotating shaft 66 thereby rotating the workpiece 12 about its axis. This mechanism has the advantage that it can accommodate workpieces 12 having a variety of diameters while assuring that the workpiece is properly aligned within the machine.

A gas jet 67 is used to quench the workpiece after heating with the laser, as described previously.

While manual operation of the heat treating apparatus 30 is described in FIGS. 5 and 6, it is apparent that various automatic means may be used to load the workpieces within the machine as well as to automatically pivot the rocker arm 54 in and out of engagement with the workpiece 12 and the rotating shaft 66. For example, a Geneva mechanism may be used for this purpose.

Rotating workpiece 12 is scanned by the laser beam by moving the laser delivery optics along the length of the workpiece. This is accomplished by providing for an optical delivery carriage 70 which is supported, and transported by, a lead screw 72 driven by a lead screw motor 74. The mirror 39 and the cylindrical lense 40 are connected to the carriage 70 by means of a support bracket 76. The distal end of the lead screw 72 is suitably mounted to the support 69. Thus, as the lead screw 72 is rotated by the lead screw motor 74, the reflector 39 and the cylindrical lense 40 are traversed along the workpiece 12. Since the workpiece 12 is also rotating, a spiral work-treated area is provided on the workpiece 12, as previously described.

In the particular embodiment shown in FIGS. 5 and 6, a 500 watt Coherent EVERLASE TM laser was used.

The terms and expressions which have been employed here are used as terms of description and not of limitations, and there is no intention, in the use of such terms and expressions, of excluding equivalents of the features shown and described, or portions thereof, it being recognized that various modifications are possible within the scope of the invention claimed.

What is claimed is:

1. A method of heat treating a transformation hardenable workpiece comprising the steps of:

directing a laser beam onto the surface of the workpiece at sufficiently high power densities to cause an incandescent reaction above the workpiece melting temperature with the workpiece; and limiting the incandescent reaction at any given area of the workpiece surface to a sufficiently short period of time to prevent any substantial melting of the workpiece.

2. A method of heat treating as recited in claim 1 including the additional step of pre-conditioning the workpiece prior to the laser directing step by black oxide coating the surface of the workpiece which is absorbtive of the wavelength of the laser beam.

3. A method of heat treating as recited in claim 2 including the additional step of quenching the workpiece with a gaseous jet.

4. A method of heat treating as recited in claim 1 including the additional step of quenching the workpiece with a gaseous jet.

5. A method of heat treating as recited in claim 1 wherein the second step includes the steps of:

focusing the laser beam into a narrow line where it intersects the workpiece; and traversing the laser beam along the workpiece with the laser beam line oriented in a direction generally perpendicular to the traverse direction.

6. A method of heat treating as recited in claim 1 wherein the second step includes the step of traversing the laser beam across the workpiece for a dwell time short enough to prevent any substantial melting.

7. A method of heat treating a cylindrical shaft of a transformation hardenable material without substantial distortion comprising the steps of:

directing a laser beam to the outside surface of the cylindrical shaft at sufficiently high power densities so as to cause a substantially instantaneous incandescent reaction above the melting temperature of the material with the shaft;

limiting the dwell time of the laser beam at any given point on the surface of the shaft to prevent any substantial melting of the shaft by (i) rotating the shaft about its longitudinal axis, (ii) traversing the laser beam longitudinally along the outside surface of the rotating shaft, whereby a spiral shaped heat-treated band is formed on the cylindrical shaft, (iii) forming the laser beam into a thin line of light at the shaft, with the line of light oriented in a direction parallel with the longitudinal axis of the shaft;

(iv) pre-conditioning the shaft to be heat treated with a uniform coating of a material which is absorbtive of the laser beam wavelength, and (v) selecting the rotational speed of the shaft and the laser beam scanning rate such that the resulting heat treated spiral band is separated by a non-heat treated spiral band.

8. A method as in claim 7 wherein the last step comprises black oxide coating the shaft.

9. A method as in claim 8 including the step of quenching the shaft with a gaseous jet.

10. A method as in claim 9 wherein the laser directing step includes the step of directing the laser beam off of the vertical axis of the shaft.

11. Apparatus for heat treating a transformation hardenable workpiece comprising:

means for directing a laser beam onto the surface of the workpiece at sufficiently high power densities to cause an incandescent reaction above the melting temperature of the material with the workpiece; and means for limiting the incandescent reaction at any given area of the workpiece surface to a sufficiently short period of time to prevent any substantial melting of the workpiece.

12. Apparatus as in claim 11 including means for pre-conditioning the workpiece by forming a thin, uniform black oxide coating on the surface of the workpiece which is absorbtive of the wavelength of the laser beam.

13. Apparatus as in claim 12 including means for quenching the workpiece with a gaseous jet.

14. Apparatus as in claim 11 including means for quenching the workpiece with a gaseous jet.

15. Apparatus as in claim 11 wherein the means for limiting the incandescent reaction comprises:

means for focusing the laser beam into a narrow line where it intersects the workpiece; and means for traversing the laser beam along the workpiece with the laser beam line oriented in a direction generally perpendicular to the traverse direction.

16. Apparatus as in claim 11 wherein said limiting means includes means for traversing the laser beam across the workpiece for a dwell time short enough to prevent any substantial melting.

17. Apparatus as in claim 11 wherein said directing means provides energy densities at the surface of the workpiece within a range of about 100 to $160\times10^3$ watts/square inch.

18. Apparatus as in claim 17 wherein the limiting means provides a dwell time of about 0.017 to 0.026 seconds.

19. Apparatus as in claim 15 wherein said focusing means comprises a cylindrical lense.

20. Apparatus for heat treating a cylindrical shaft of a transformation hardenable material without substantial distortion comprising:

means directing a laser beam to the outside surface of the cylindrical shaft at sufficiently high power densities to cause a substantially instantaneous incandescent reaction above the melting point of the material with the shaft;

means for limiting the dwell time of the laser beam at any given point on the surface of the shaft to prevent any substantial melting of the shaft, said limiting means comprising:

(i) means for rotating the shaft about its longitudinal axis, (ii) means for traversing the laser beam longitudinally of the rotating shaft, whereby a spiral shaped heat-treated band is formed on the cylindrical shaft, (iii) means for forming the laser beam into a thin line of light oriented in a direction parallel with the longitudinal axis of the shaft, (iv) means for pre-conditioning the shaft to be heat treated with a uniform coating of a material which is absorbtive of the laser beam wavelength, and (v) means for selecting the rotational speed of the shaft and the laser beam scanning rate such that the resulting heat treated spiral band is separated by a non-heat treated spiral band.

21. Apparatus as in claim 20 including means for quenching the shaft with a gaseous jet.

22. Apparatus as in claim 21 wherein the laser directing means includes the means for directing the laser beam off of the vertical axis of the shaft.

23. Apparatus as in claim 20 wherein said coating comprises an oxide.

24. Apparatus as in claim 20 wherein said coating comprises a black oxide.

25. Apparatus as in claim 20 wherein said directing means provides energy densities at the surface of the shaft within a range of about 100 to $160\times10^3$ watts/square inch.

26. Apparatus as in claim 25 wherein the limiting means provides a dwell time of about 0.017 to 0.026 seconds.

27. Apparatus as in claim 20 wherein said beam forming means comprises a cylindrical lense.

28. A method as in claim 7 including the step of starting and stopping the spiral shaped heat-treated band at substantially the same angular position along the shaft to minimize distortion of the shaft.

29. Apparatus as in claim 20 including means for starting and stopping the spiral shaped heat-treated band at substantially the same angular position along the shaft to minimize distortion of the shaft.

* * * * *